US008872874B2

(12) United States Patent
Kim

(10) Patent No.: US 8,872,874 B2
(45) Date of Patent: Oct. 28, 2014

(54) LIGHT SCANNING UNIT AND ELECTROPHOTOGRAPHIC IMAGE FORMING APPARATUS USING THE SAME

(75) Inventor: Hyung-soo Kim, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 142 days.

(21) Appl. No.: 13/292,476

(22) Filed: Nov. 9, 2011

(65) Prior Publication Data

US 2012/0127256 A1 May 24, 2012

(30) Foreign Application Priority Data

Nov. 19, 2010 (KR) ..... 10-2010-0115758

(51) Int. Cl.

| | |
|---|---|
| ***B41J 2/385*** | (2006.01) |
| ***B41J 15/14*** | (2006.01) |
| ***B41J 27/00*** | (2006.01) |
| ***G03G 15/04*** | (2006.01) |

(52) U.S. Cl.

CPC ..... *G03G 15/0409* (2013.01)
USPC ..... 347/243; 347/137; 347/259; 347/261

(58) Field of Classification Search

USPC ..... 347/134, 137, 243, 258, 259, 260, 261
See application file for complete search history.

(56) References Cited

U.S. PATENT DOCUMENTS

| | | | | |
|---|---|---|---|---|
| 6,304,360 | B1 * | 10/2001 | Sekikawa | 359/204.1 |
| 2006/0017998 | A1 * | 1/2006 | Fujino | 359/204 |
| 2006/0126147 | A1 * | 6/2006 | Takakubo | 359/204 |

FOREIGN PATENT DOCUMENTS

| | | |
|---|---|---|
| JP | 2000-180750 | 6/2000 |
| JP | 2005-91966 | 4/2005 |
| JP | 2007-171979 | 7/2007 |

OTHER PUBLICATIONS

European Search Report dated Jun. 30, 2014 issued in EP Application No. 11187528.2.

* cited by examiner

*Primary Examiner* — Justin Seo
*Assistant Examiner* — Kendrick Liu
(74) *Attorney, Agent, or Firm* — Stanzione & Kim, LLP

(57) ABSTRACT

A light scanning unit and an electrophotographic image forming apparatus employing the same. The light scanning unit includes an imaging optical system including, when a path of one of the light beams directed to one of the surfaces disposed relatively far from the deflector is referred to as a first light path and when a path of one of the light beams directed to one of the surfaces disposed relatively close to the deflector is referred to as a second light path, light paths in which both of a section of the second light path before a first change of the second light path and a section of the second light path after the first change of the second light path intersect a section of the first light path after a second change of the first light path.

32 Claims, 5 Drawing Sheets

LIGHT SCANNING UNIT AND ELECTROPHOTOGRAPHIC IMAGE FORMING APPARATUS USING THE SAME

CROSS-REFERENCE TO RELATED APPLICATIONS

This application claims the benefit of Korean Patent Application No. 10-2010-0115758, filed on Nov. 19, 2010, in the Korean Intellectual Property Office, the disclosure of which is incorporated herein in its entirety by reference.

BACKGROUND OF THE INVENTION

1. Field of the Invention

The exemplary embodiments relate to a light scanning unit and an electrophotographic image forming apparatus employing the same, and more particularly, to a tandem light scanning unit and an electrophotographic image forming apparatus employing the same.

2. Description of the Related Art

Light scanning units are employed in electrophotographic image forming apparatuses such as laser printers, and scan a laser beam onto a photoreceptor to form an electrostatic latent image. A light scanning unit includes an optical deflector for deflecting a light beam emitted from a light source and scanning the light beam onto a photoreceptor, and an imaging optical system positioned between the deflector and the photoreceptor and for focusing the deflected light beam before the light beam is scanned onto the photoreceptor.

In an electrophotographic image forming apparatus, if a light scanning unit scans a light beam onto a photoreceptor such as a photosensitive drum, via main scanning performed by the light scanning unit and sub scanning performed due to movement of the photoreceptor, an electrostatic latent image is formed on the photoreceptor. The formed electrostatic latent image is developed into a development image by using a developer such as toner, and the development image is transferred onto a printing medium.

Recently, technologies for reducing a size of an image forming apparatus such as a color laser printer are being developed, and as part of an effort to develop the technologies, technologies for reducing a size of a color developing structure are being developed.

SUMMARY OF THE INVENTION

As photoreceptors corresponding to each of colors to be printed are required to be arranged with narrow intervals in making a color developing structure small, the exemplary embodiments provide a light scanning unit having optical components appropriate for the narrow intervals of the photoreceptors, and an electrophotographic image forming apparatus employing the light scanning unit.

Additional aspects and advantages of the present general inventive concept will be set forth in part in the description which follows and, in part, will be obvious from the description, or may be learned by practice of the general inventive concept.

According to an exemplary embodiment, there is provided a light scanning unit including: a plurality of light sources configured to emit a plurality of light beams; a deflector configured to deflect the light beams emitted from the light sources in a main scanning direction; and an imaging optical system configured to respectively focus the light beams deflected by the deflector onto a plurality of surfaces to be scanned, the imaging optical system including: a first group of reflecting members configured to change a first light path at least twice, the first light path being a path of one of the light beams directed to one of the surfaces disposed relatively far from the deflector; and a second group of reflecting members configured to change a second light path at least twice, the second light path being a path of one of the light beams directed to one of the surfaces disposed relatively close to the deflector, wherein both of a section of the second light path before a first change of the second light path and a section of the second light path after the first change of the second light path intersect a section of the first light path after a second change of the first light path.

A section of the first light path before a first change of the first light path may be disposed below the section of the second light path before the first change of the second light path with respect to a sub scanning direction, and the section of the second light path after the first change of the second light path may intersect the section of the first light path before the first change of the first light path. In this case, the section of the second light path before the first change of the second light path may intersect a section of the second light path after a second change of the second light path. Also, the section of the first light path before the first change of the first light path may intersect the section of the first light path after the second change of the first light path. In addition, the section of the first light path before the first change of the first light path may intersect a section of the second light path after a second change of the second light path.

A section of the first light path before a first change of the first light path may be disposed above the section of the second light path before the first change of the second light path with respect to a sub scanning direction, and wherein the first light path surrounds a first reflecting member of the second group and is directed to one of the surfaces. In this case, the section of the second light path before the first change of the second light path may intersect a section of the second light path after a second change of the second light path. Also, the section of the first light path before the first change of the first light path may intersect the section of the first light path after the second change of the first light path. In addition, the section of the first light path before the first change of the first light path may intersect a section of the second light path after a second change of the second light path.

The imaging optical system may include a first scanning lens that is commonly disposed on the first and second light paths, and second scanning lenses that are respectively disposed on the first and second light paths.

The first scanning lens may be disposed in sections of the first and second light paths before first changes of the first and second light paths, and the second scanning lenses may be respectively disposed in sections of the first and second light paths after the first changes of the first and second light paths.

A first light beam on the first light path and a second light beam on the second light path may be incident on a deflection surface of the deflector at different angles. The first light beam on the first light path and the second light beam on the second light path may be symmetrically incident on the deflection surface of the deflector with respect to a rotation axis of the deflector.

The first light path and the second light path may be disposed at one side of the deflector, and the imaging optical system may further include reflecting members and scanning lenses disposed on third and fourth light paths that are symmetrical to the first and second light paths with respect to the deflector.

The third and fourth light paths may be symmetrical to the first and second light paths with respect to a rotation axis of the deflector.

The number of reflecting members of the first group and the number of reflecting members of the second group may be each at least two.

The light paths respectively directed to the surfaces may be spaced apart from one another at regular intervals.

According to another exemplary embodiment, there is provided an image forming apparatus including: a light scanning unit including a plurality of light sources configured to emit a plurality of light beams, a deflector configured to deflect the light beams emitted from the light sources in a main scanning direction, and an imaging optical system configured to respectively focus the light beams deflected by the deflector onto a plurality of surfaces to be scanned, the imaging optical system including: a first group of reflecting members configured to change a first light path at least twice, the first light path being a path of one of the light beams directed to one of the surfaces disposed relatively far from the deflector; and a second group of reflecting members configured to change a second light path at least twice, the second light path being a path of one of the light beams directed to one of the surfaces disposed relatively close to the deflector, wherein a section of the second light path before a first change of the second light path and a section of the second light path after the first change of the second light path intersect a section of the first light path after a second change of the first light path; a developing unit including a plurality of photoreceptors disposed on each of focusing points of the light beams emitted from the light scanning unit and a developing roller configured to develop an electrostatic latent image formed on each of the photoreceptors; and a transfer unit configured to transfer an image developed by the developing unit.

According to another exemplary embodiment, there is provided a light scanning unit having: a plurality of light sources configured to emit a plurality of light beams; a deflector configured to deflect the plurality of light beams in a first direction; and an imaging optical system configured to respectively focus the plurality of light beams deflected by the deflector onto a plurality of surfaces, the imaging optical system including: at least two reflectors of a first group of reflectors configured to reflect a first light path at least twice, the first light path having a first portion, a second portion and a third portion, and being directed onto a first surface; and at least two reflectors of a second group of reflectors configured to reflect a second light path at least twice, the second light path having a first portion, a second portion and a third portion, and being directed onto a second surface disposed closer to the deflector than the first surface with respect to the first direction, wherein the first portion of the second light path that is incident on a first reflector of the at least two reflectors of the second group of reflectors and the second portion of the second light path that is reflected by the first reflector of the at least two reflectors of the second group of reflectors intersect the third portion of the first light path that is reflected by both a first reflector and a second reflector of the at least two reflectors of the first group of reflectors.

The imaging optical system may be configured to focus the plurality of light beams in a second direction, and the first direction may be substantially perpendicular to the second direction.

The first portion of the first light path that is incident on the first reflector of the at least two reflectors of the first group of reflectors may be disposed below the first portion of the second light path that is incident on the first reflector of the at least two reflectors of the first group of reflectors with respect to the second direction.

A third portion of the second light path that is reflected by both the first reflector and a second reflector of the at least two reflectors of the second group of reflectors may intersect the first portion of the first light path that is incident on the first reflector of the at least two reflectors of the first group of reflectors.

The second portion of the second light path that is reflected by the first reflector of the at least two reflectors of the second group of reflectors may intersect the first portion of the first light path that is incident on the first reflector of the at least two reflectors of the first group of reflectors.

The first portion of the first light path that is incident on the first reflector of the at least two reflectors of the first group of reflectors may intersect the third portion of the first light path that is reflected by both the first reflector and the second reflector of the at least two reflectors of the first group of reflectors.

The second portion of the first light path that is incident on the first reflector of the at least two reflectors of the second group of reflectors may intersect the third portion of the second light path that is reflected by both the first reflector and a second reflector of the at least two reflectors of the second group of reflectors.

The first portion of the first light path that is incident on the first reflector of the at least two reflectors of the first group of reflectors may be disposed above the first portion of the second light path that is incident on the first reflector of the at least two reflectors of the first group of reflectors with respect to the second direction.

The first portion of the second light path that is incident on the first reflector of the at least two reflectors of the second group of reflectors may intersect the third portion of the second light path that is reflected by both the first reflector and a second reflector of the at least two reflectors of the second group of reflectors.

The first portion of the first light path that is incident on the first reflector of the at least two reflectors of the first group of reflectors may intersect the third portion of the first light path that is reflected by both the first reflector and the second reflector of the at least two reflectors of the first group of reflectors.

The first portion of the first light path that is incident on the first reflector of the at least two reflectors of the first group of reflectors may intersect the third portion of the second light path that is reflected by both the first reflector and the second reflector of the at least two reflectors of the second group of reflectors.

Both the first portion of the second light path that is incident on the first reflector of the at least two reflectors of the second group of reflectors and the second portion of the second light path that is reflected by the first reflector of the at least two reflectors of the second group of reflectors may intersect the third portion of the first light path that is reflected by both the first reflector and a second reflector of the at least two reflectors of the first group of reflectors.

The imaging optical system may further include: a first scanning lens that is commonly disposed on the first and second light paths, and a plurality of second scanning lenses that are respectively disposed on the first and second light paths.

The first scanning lens may be disposed in both the first portion the first light path that is incident on the first reflectors of the at least two reflectors of the first group of reflectors and the second portion the second light path that is incident on the first reflectors of the at least two reflectors of the second group of reflectors, and the plurality of second scanning lenses may be respectively disposed in both the second portions of the first and second light paths that are reflected by the first reflectors of the at least two reflectors of the first and second groups of reflectors.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE EXEMPLARY EMBODIMENTS

Figure 1:
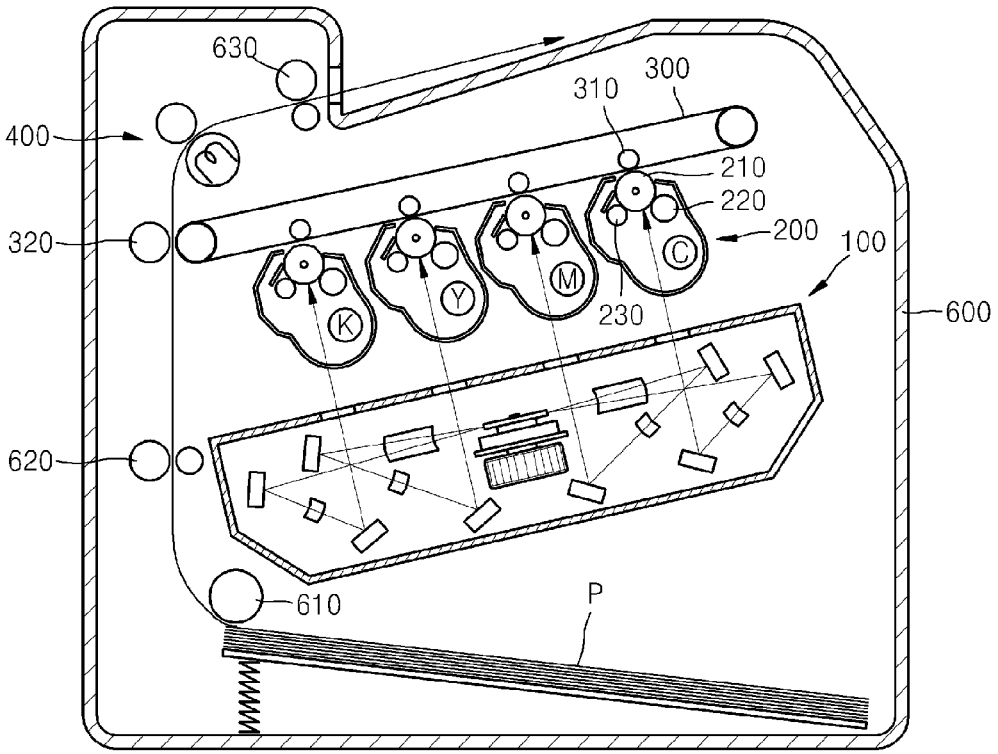
FIG. 1 is a schematic view illustrating an image forming apparatus according to an exemplary embodiment.

Reference will now be made in detail to the exemplary embodiments of the present general inventive concept, examples of which are illustrated in the accompanying drawings, wherein like reference numerals refer to the like elements throughout. The exemplary embodiments are described below in order to explain the present general inventive concept while referring to the figures.

FIG. 1 is a view illustrating an electrophotographic image forming apparatus employing a light scanning unit according to an embodiment of the present inventive concept. The image forming apparatus illustrated in FIG. 1 is a dry-type electrophotographic image forming apparatus that prints a color image by using a dry developer (hereinafter, referred to as toner).

The image forming apparatus includes a light scanning unit 100, a plurality of developing units 200, an intermediate transfer belt 300, first and second transfer rollers 310 and 320, and a fixing device 400 that are accommodated in a cabinet 600.

In order to print a color image, the light scanning unit 100 scans a plurality of light beams, and the developing units 200, one for each of colors to be printed, may be formed to correspond to the plurality of light beams. For example, the light scanning unit 100 may scan four light beams corresponding to black (K), magenta (M), yellow (Y), and cyan (C). The light scanning unit 100 will be described in greater detail below with reference to FIGS. 2 through 4.

The developing units 200 each include a photosensitive drum 210, that is, an image receptor, on which an electrostatic latent image is formed and a developing roller 220 for developing the electrostatic latent image. The developing units 200 for K, M, Y, and C may be formed.

The photosensitive drum 210, that is, a photoreceptor, may be a cylindrical metal pipe having a photosensitive layer that has a predetermined thickness and that is formed on an outer circumference of the cylindrical metal pipe. The outer circumference of the photosensitive drum 21 is a surface that is to be exposed. The photosensitive drum 210 is exposed out of the developing unit 200. The photosensitive drums 210 are arranged so as to be spaced apart from one another at predetermined intervals in a sub scanning direction. Alternatively, a photosensitive belt may be employed instead of the photosensitive drum 210 as a photoreceptor.

A charge roller 230 is disposed on a portion of the outer circumference of the photosensitive drum 210 upstream from a region of the outer circumference that is to be exposed to the light scanning unit 100. The charge roller 230 is a charging unit that contacts the photosensitive drum 210 and rotates to apply a uniform charge to the surface of the photosensitive drum 210. A charge bias is applied to the charge roller 230. Alternatively, a corona charging unit (not shown) may be used instead of the charge roller 230.

The developing roller 220 supplies toner adhered to its outer circumference to the photosensitive drum 210. A development bias is applied to the developing roller 220 to supply the toner to the photosensitive drum 210. Although it is not illustrated in the drawings, the developing units 200 may further include a supply roller to allow toner contained in the developing units 200 to adhere to the developing roller 220, a regulation unit to regulate an amount of the toner adhered to the developing roller 220, and an agitator to transfer the toner contained in each of the developing units 200 to the supply roller and/or the developing roller 220.

The intermediate transfer belt 300 is disposed to face a region of the outer circumference of the photosensitive drum 210 exposed out of the developing units 200. The intermediate transfer belt 300 is an example of an intermediate transfer body to transfer toner images of the photosensitive drums 210 to a paper P. An intermediate transfer drum may be used instead of the intermediate transfer belt 300 as the intermediate transfer body. The intermediate transfer belt 300 circulates by contacting the photosensitive drums 210. The first transfer rollers 310 are disposed to face the photosensitive drums 210 with the intermediate transfer belt 300 interposed therebetween. A first transfer bias is applied to each of the first transfer rollers 310 so as to transfer the toner images of the photosensitive drums 210 to the intermediate transfer belt 300 to form a color toner image.

The second transfer roller 320 is disposed to face the intermediate transfer belt 300, and the paper P may pass between the second transfer roller 320 and the intermediate transfer belt 300. A second transfer bias is applied to the second transfer roller 320 so as to transfer the color toner image of the intermediate transfer belt 300 to the paper P.

A color image forming process that may be performed by the above-described electrophotographic image forming apparatus will be described in detail below.

The photosensitive drum 210 of each developing unit 200 is charged to have a uniform electric potential by a charge bias applied to the charge roller 230.

The light scanning unit 100 exposes the surface of the photosensitive drum 210 in a lengthwise (axial) direction of the photosensitive drum 210, that is, in a main scanning direction. The exposed surface of the photosensitive drum 210 moves in a sub scanning direction according to rotation of the photosensitive drum 210. Thus, a two-dimensional electrostatic latent image is formed on the exposed surface of each of the four photosensitive drums 210 according to image information of K, M, Y, and C. In this regard, the sub scanning direction is a direction perpendicular to the main scanning direction. The four developing units 200 respectively supply toners of K, M, Y, and C to the photosensitive drums 210 so as to form toner images of K, M, Y, and C.

The toner images of K, M, Y, and C formed on the photosensitive drums 210 are transferred onto the intermediate transfer belt 300 while overlapping each other due to the first transfer bias applied to the first transfer rollers 310, thereby forming a color toner image.

A medium that finally receives the color toner image, for example, the paper P, is transferred between the intermediate transfer belt 300 and the second transfer roller 320 by a pickup roller 610 and a transfer roller 620. The color toner image on the intermediate transfer belt 300 is transferred onto the paper P due to the second transfer bias applied to the second transfer roller 320. The color toner image transferred onto the paper P is maintained on a surface of the paper P due to an electrostatic force. The paper P onto which the color toner image is transferred is sent to a fixing device 400. The color toner image transferred onto the paper P is fixed on the paper P by receiving heat and pressure from a fixing nip of the fixing device 400. The paper P after being subjected to the fixing process is ejected out of the image forming apparatus by an eject roller 630.

Figure 2:
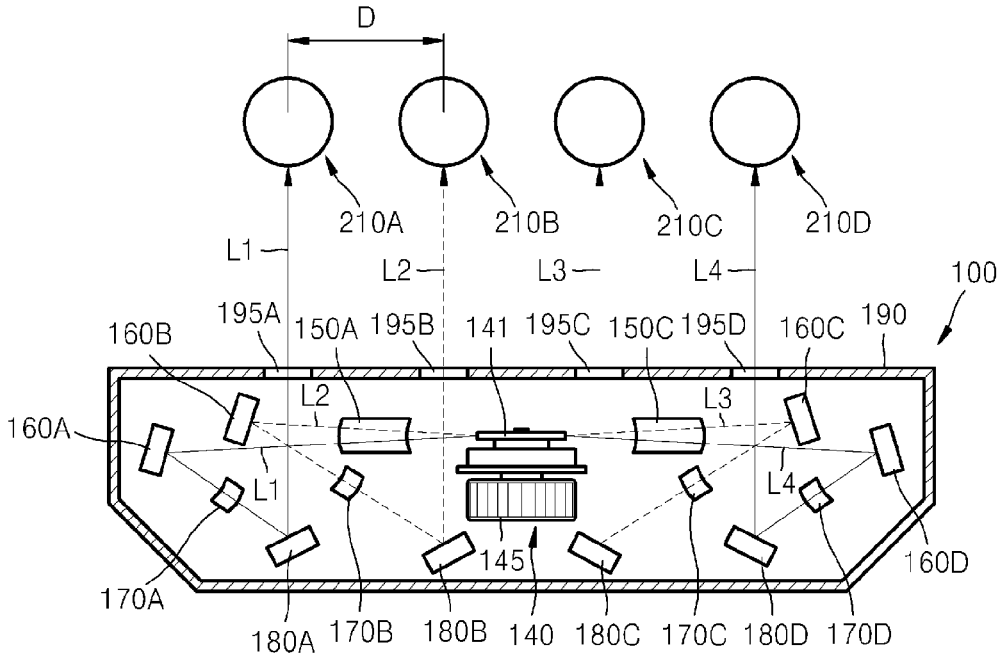
FIG. 2 is a view illustrating a light scanning unit employed in the image forming apparatus of FIG. 1.
Figure 3:
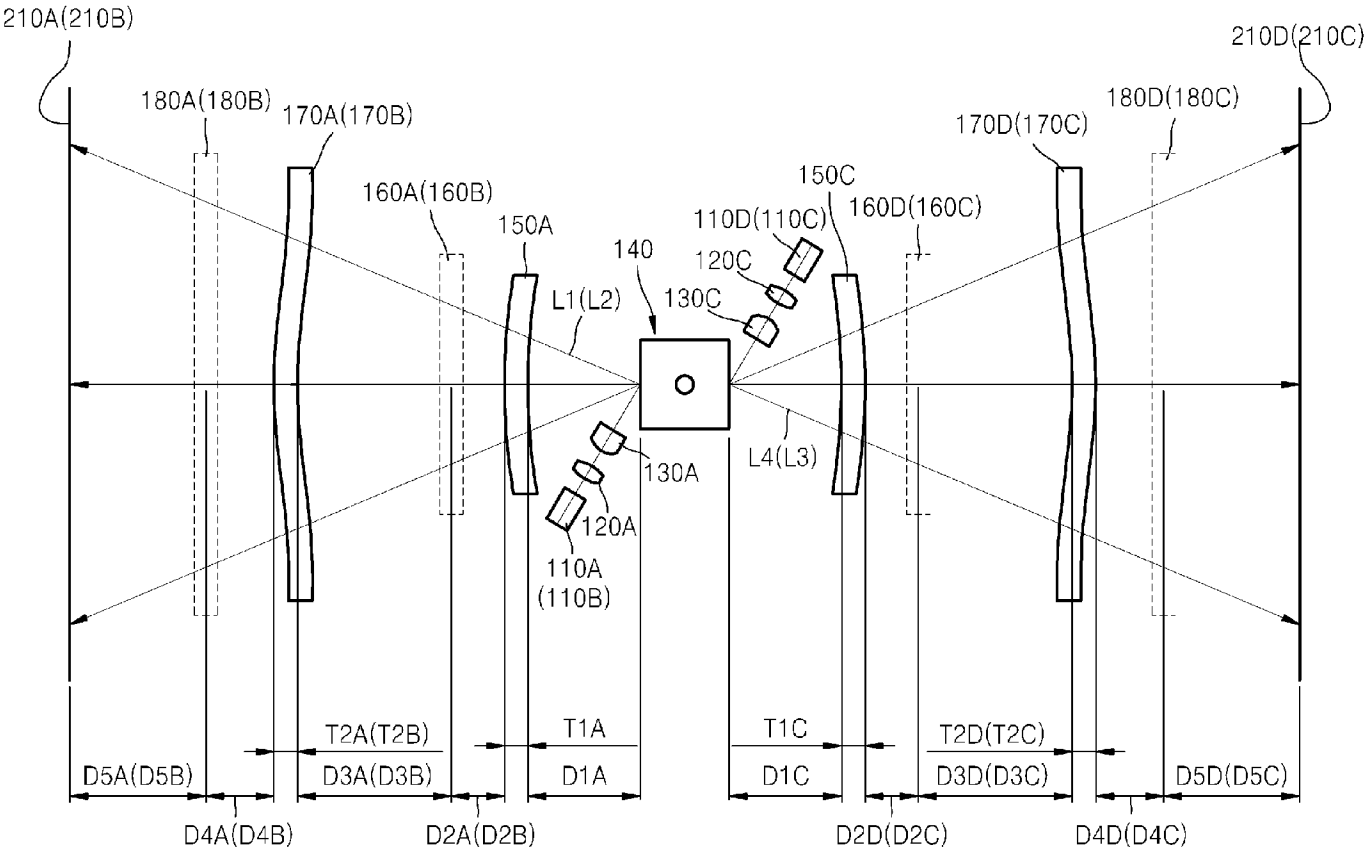
FIG. 3 is a view illustrating an optical arrangement of the light scanning unit of FIG. 2.

FIG. 2 is a view illustrating the light scanning unit 100 employed in the image forming apparatus illustrated in FIG. 1 with respect to a sub scanning plane. FIG. 3 is a view illustrating an optical arrangement of the light scanning unit 100 with respect to a main scanning plane. For convenience of description, changes in light paths due to reflecting members 160A, 160B, 160C, 160D, 180A, 180B, 180C, and 180D are ignored, and FIG. 2 illustrates only one set of overlapping optical components due to first through fourth light beams L1, L2, L3, and L4 that are incident on a deflector 140 in a vertical direction. In this regard, the main scanning plane and the sub scanning plane are defined according to scanned surfaces (that is, upper surfaces) of photosensitive drums 210A, 210B, 210C, and 210D. That is, the main scanning plane is defined as a surface including a main scanning line of a light beam scanned on an upper surface and crossing the upper surface at right angles, and the sub scanning plane is defined as a surface crossing the upper surface and the main scanning plane at a right angle. A main scanning plane and a sub scanning plane on an arbitrary light path are virtual planes corresponding to the main scanning plane and the sub scanning plane defined according to the upper surface as described above. The sub scanning direction is perpendicular to a direction along which the light beams L1, L2, L3, and L4 propagate when seen from the sub scanning plane of FIG. 2. The main scanning direction is a direction along which the light beams L1, L2, L3, and L4 are scanned or swept when seen from the main scanning plane of FIG. 3.

Referring to FIGS. 2 and 3, the light scanning unit 100 of the current embodiment, which is a unit to scan the first through fourth light beams L1, L2, L3, and L4 in a main scanning direction, includes light sources 110A, 110B, 110C, and 110D, the single deflector 140, and an imaging optical system. The photosensitive drums 210A, 210B, 210C, and 210D are disposed spaced apart from one another at predetermined intervals in a sub scanning direction, and the light scanning unit 100 scans the first through fourth light beams L1, L2, L3, and L4, which are spaced apart from one another at predetermined intervals in the sub scanning direction, in such a way as to respectively correspond the first through fourth light beams L1, L2, L3, and L4 to positions of the photosensitive drums 210A, 210B, 210C, and 210D.

The light sources 110A, 110B, 110C, and 110D, which emit the first through fourth light beams L1, L2, L3, and L4, may be laser diodes that emit a laser beam. In FIG. 3, the two light sources 110A and 110B are disposed at a left lower side of the deflector 140, in such a way that the first and second light beams L1 and L2 are incident on a left deflection surface of the deflector 140 at different angles and deflect in a sub scanning direction. Similarly, the two light sources 110C and 110D are disposed at a right upper side of the deflector 140, in such a way that the third and fourth light beams L3 and L4 are incident on a right deflection surface of the deflector 140 at different angles and deflect in a sub scanning direction. Here, the sub scanning direction is parallel to the rotation axis of the deflector 140. Furthermore, the light sources 110A, 110B, 110C, and 110D may be disposed in such a way that the first and second light beams L1 and L2 on a left side are incident on the left deflection surface of the deflector 140 to be vertically symmetrical to each other, and in such a way that the third and fourth light beams L3 and L4 on a right side are incident on the right deflection surface of the deflector 140 to be vertically symmetrical to each other.

In FIG. 3, the light sources 110A, 110B, 110C, and 110D are respectively prepared to emit the first through fourth light beams L1, L2, L3, and L4, but the present invention is not limited thereto. For example, one multi-beam laser diode may be employed as the light sources 110A and 110B to emit the first and second light beams L1 and L2 on the left side, and one multi-beam laser diode may be employed as the light sources 110C and 110D to emit the two light beams L3 and L4 on the right side.

A collimating lens 120A to collimate the first and second light beams L1 and L2 and a cylindrical lens 130A to focus the first and second light beams L1 and L2 onto a deflection surface of the deflector 140 to deflect the first and second light beams L1 and L2 in a sub scanning direction may be prepared between the light sources 110A and 110B and the deflector 140 on the left side. At this time, the collimating lens 120A and the cylindrical lens 130A may be commonly used with respect to the first and second light beams L1 and L2. Under different conditions, the collimating lens 120A and the cylindrical lens 130A may be separately prepared for each of the first and second light beams L1 and L2. Similarly, a collimating lens 120C to focus the third and fourth light beams L3 and L4 and a cylindrical lens 130C to focus the third and fourth light beams L3 and L4 onto a deflection surface of the deflector 140 to deflect the third and fourth light beams L3 and L4 in a sub scanning direction may be prepared between the light sources 110C and 110D and the deflector 140 on the right side.

The deflector 140 may include a rotational polygon mirror 141 having a plurality of deflection surfaces, that is, a plurality of reflection surfaces, and a motor 145 to rotate the rotational polygon mirror 141. The deflector 140 deflects the first through fourth light beams L1, L2, L3, and L4, which are deflected according to rotation of the rotational polygon mirror 141, in a main scanning direction. FIG. 3 illustrates the deflector 140 having four deflection surfaces, but the present invention is not limited thereto.

The imaging optical system is an optical unit to focus each of the first through fourth light beams L1, L2, L3, and L4 deflected by the deflector 140 onto the outer circumferences of the photosensitive drums 210A, 210B, 201C, and 210D, that is, onto surfaces that are to be scanned. The imaging optical system may include optical components such as first scanning lenses 150A and 150C, second scanning lenses 170A, 170B, 170C, and 170D, and the plurality of reflecting members 160A, 160B, 160C, 160D, 180A, 180B, 180C, and 180D. The optical components of the imaging optical system may be symmetrically disposed at opposite sides of the deflector 140.

The first scanning lenses 150A and 150C and the second scanning lenses 170A, 170B, 170C, and 170D may be fθ lenses to focus the first through fourth light beams L1, L2, L3, and L4 deflected by the deflector 140 onto the photosensitive drums 210A, 210B, 201C, and 210D at a constant velocity. Optical designs of the first scanning lenses 150A and 150C and the second scanning lenses 170A, 170B, 170C, and 170D may vary according to distances between the deflector 140 and the photosensitive drum 210A, 210B, 210C, and 210D and positions of the first scanning lenses 150A and 150C and the second scanning lenses 170A, 170B, 170C, and 170D.

The reflecting members 160A, 160B, 160C, 160D, 180A, 180B, 180C, and 180D change paths of the first through fourth light beams L1, L2, L3, and L4 and each may be a reflection mirror or a total reflection prism. Intervals D between the photosensitive drums 210A, 210B, 210C, and 210D correspond to distances between the first through fourth light beams L1, L2, L3, and L4 scanned from the light scanning unit 100 in a sub scanning direction, and thus the distances between the first through fourth light beams L1, L2, L3, and L4 in the sub scanning direction may be minimized so as to minimize the intervals D between the photosensitive drums 210A, 210B, 210C, and 210D. In the light scanning unit 100 of the current exemplary embodiment, positions of the plurality of reflecting members 160A, 160B, 160C, 160D, 180A, 180B, 180C, and 180D may be optimized so as to minimize the intervals D between the photosensitive drums 210A, 210B, 210C, and 210D.

Hereinafter, an optical arrangement of the imaging optical system, in particular, a portion of the imaging optical system disposed on the left side of the deflector 140, will be described according to the paths of the first through fourth light beams L1, L2, L3, and L4 in the imaging optical system. The paths of the first and fourth light beams L1 and L4 directed to the photosensitive drums 210A and 210D disposed relatively far from the deflector 140 may be symmetric with respect to the deflector 140 and the paths of the second and third light beams L2 and L3 directed to the photosensitive drums 210B and 210C disposed relatively close to the deflector 140 may be symmetric with respect to the deflector 140, as illustrated in FIG. 2, and thus it may be understood that a portion of the imaging optical system disposed on the right side of the deflector 140 is symmetrical to the portion of the imaging optical system disposed on the left side of the deflector 140.

When the first and second light beams L1 and L2 are incident on the deflector 140 at different angles with respect to a sub scanning direction, the first and second light beams L1 and L2 reflected by the deflector 140 are directed to the first scanning lens 150A in a sub scanning direction at predetermined angles. At this time, when seen from the sub scanning plane of FIG. 2, the path of the first light beam L1 reflected by the deflector 140 is below the path of the second light beam L2 reflected by the deflector 140. Hereinafter, both the first light beam L1 and the path of the first light beam L1 (hereinafter, referred to as a first light path) are represented by L1, and both the second light beam L2 and the path of the second light beam L2 (hereinafter, referred to as a second light path) are represented by L2.

The first light path L1 is changed at least twice by the reflecting members 160A and 180A of a first group so as to be directed to the photosensitive drum 210A disposed relatively far from the deflector 140. Similarly, the second light path L2 is changed at least twice by the reflecting members 160B and 180B of a second group so as to be directed to the photosensitive drum 210A disposed relatively close to the deflector 140. In FIG. 3, the first and second light paths L1 and L2 are changed twice, but the exemplary embodiments are not limited thereto. That is, the first and second light paths L1 and L2 may be changed more than twice.

The first scanning lens 150A is commonly disposed on both the first light path L1 and the second light path L2, and the second scanning lenses 170A and 170B are disposed on the first light path L1 and the second light path L2, respectively.

The first reflecting member 160A of the first group is disposed on the first light path L1 between the first scanning lens 150A and the second scanning lens 170A, and the first reflecting member 160A is configured to change the first light path L1 for the first time. The second reflecting member 180A of the first group is disposed on a section of the first light path L1 after the second scanning lens 170A, and is configured to change the first light path L1 for the second time. A section of the first light path L1 after the second reflecting member 180A is directed to the photosensitive drum 210A disposed relatively far from the deflector 140.

Similarly, the first reflecting member 160B of the second group is disposed on the second light path L2 between the first scanning lens 150A and the second scanning lens 170B, and is configured to change the second light path L2 for the first time. The second reflecting member 180B of the second group is disposed on a section of the second light path L2 after the second scanning lens 170B, and is configured to change the second light path L2 for the second time. A section of the second light path L2 after the second reflecting member 180B is directed to the photosensitive drum 210B disposed relatively close to the deflector 140.

In particular, the section of the second light path L2 before the first change of the second light path L2 and a section of the second light path L2 after the first change of the second light path L2 intersect a section of the first light path L1 after the second change of the first light path L1 (i.e., a section of the first light path L1 directed to a surface that is to be scanned, that is, to the photosensitive drum 210A). Similarly, the section of the second light path L2 before the first change of the second light path L2 intersects a section of the second light path L2 after the second change of the second light path L2 (i.e., a section of the second light path L2 directed to a surface that is to be scanned, that is, to the photosensitive drum 210B).

Further, a section of the first light path L1 before the first change of the first light path L1 is disposed below the section of the second light path L2 before the first change of the second light path L2 with respect to a main scanning plane, and the section of the first light path L1 before the first change of the first light path L1 intersects the section of the second light path L2 after the second change of the second light path L2.

In addition, the section of the first light path L1 before the first change of the first light path L1 intersects the section of the first light path L1 after the second change of the second light path L2 (i.e., the section of the first light path L1 directed to the photosensitive drum 210A), and also intersects the section of the second light path L2 after the second change of the second light path L2 (i.e., the section of the second light path L2 directed to the photosensitive drum 210B).

In the arrangement described above, the reflecting member 160A of the first group and the reflecting member 160D, which is symmetrical to the reflecting member 160A with respect to the deflector 140, are disposed at both outermost sides of the light scanning unit 100 in a length direction of the light scanning unit 100, respectively. Further, the first reflecting member 160B and the second reflecting member 180B of the second group are disposed at both outermost sides of the light scanning unit 100 in a thickness direction of the light scanning unit 100, respectively.

As a result, light scanning unit 100 of the current exemplary embodiment may be made more compact in size by optimizing the light paths of the imaging optical system.

In particular, the intervals D between the photosensitive drums 210A, 210B, 210C, and 210D correspond to the distances between the first through fourth light beams L1, L2, L3, and L4 scanned from the light scanning unit 100 in a sub scanning direction, and thus the intervals D between the photosensitive drums 210A, 210B, 210C, and 210D may be minimized by minimizing the distances between the first through fourth light beams L1, L2, L3, and L4 in the sub scanning direction. In the light scanning unit 100 of the current embodiment, the intervals D between the photosensitive drums 210A, 210B, 210C, and 210D may be minimized by optimizing the light paths of the imaging optical system as described above.

Figure 4:
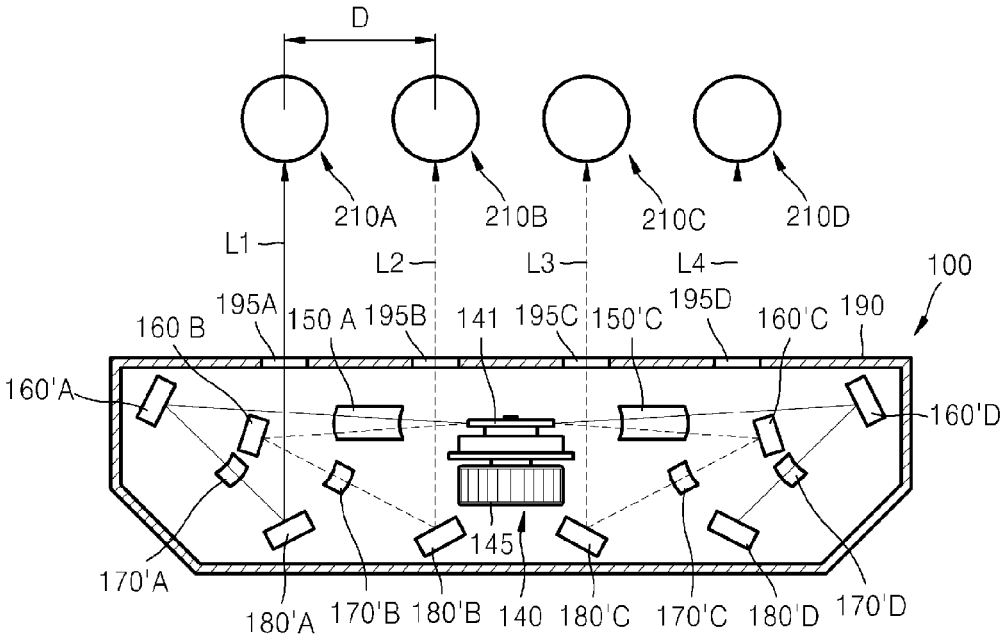
FIG. 4 is a view illustrating a light scanning unit employed in the image forming apparatus of FIG. 1, according to another exemplary embodiment.

FIG. 4 is a view illustrating a light scanning unit 100' with respect to a sub scanning plane, according to another exemplary embodiment. Except for an optical arrangement of an imaging optical system, the light scanning unit 100' of the current embodiment has the same configuration as light scanning unit 100 described with reference to FIGS. 2 and 3, and thus a detailed description thereof will be omitted.

Optical components constituting an imaging optical system of the current exemplary embodiment (first scanning lenses 150'A and 150'C, second scanning lenses 170'A, 170'B, 170'C, and 170'D, and a plurality of reflecting members 160'A, 160'B, 160'C, 160'D, 180'A, 180'B, 180'C, and 180'D) are symmetrically disposed at opposite sides of a deflector 140. Similarly to the above-described embodiment, paths of first and fourth light beams L1 and L4 directed to photosensitive drums 210A and 210D disposed relatively far from the deflector 140 may be symmetric with respect to the deflector 140 and paths of second and third light beams L2 and L3 directed to photosensitive drums 210B and 210C disposed relatively close to the deflector 140 may be symmetric with respect to the deflector 140 as illustrated in FIG. 4, and thus it may be understood that a portion of the imaging optical system disposed on a right side of the deflector 140 is symmetrical to a portion the imaging optical system disposed on a left side of the deflector 140. Thus, an optical arrangement of the portion of the imaging optical system disposed on the left side of the deflector 140 will be described for illustrative purposes.

When the first and second light beams L1 and L2 are incident on the deflector 140 at different angles, the first and second light beams L1 and L2 reflected by the deflector 140 are directed to the first scanning lens 150'A in a sub scanning direction at predetermined angles. At this time, when seen from the sub scanning plane of FIG. 4, the path of the first light beam L1 reflected by the deflector 140 is above the path of the second light beam L2 reflected by the deflector 140.

The first light path L1 is changed at least twice by the reflecting members 160'A and 180'A of a first group to be directed to the photosensitive drum 210A disposed relatively far from the deflector 140. The second light path L2 is changed at least twice by the reflecting members 160'B and 180'B of a second group to be directed to the photosensitive drum 210A disposed relatively close to the deflector 140. In FIG. 4, the first and second light paths L1 and L2 are changed twice, but the exemplary embodiments are not limited thereto. That is, the first and second light paths L1 and L2 may be changed more than twice.

The first scanning lens 150'A is commonly disposed on both the first light path L1 and the second light path L2, and the second scanning lenses 170'A and 170'B are disposed on the first light path L1 and the second light path L2, respectively. The reflecting member 160'A of the first group is disposed on the first light path L1 between the first scanning lens 150'A and the second scanning lens 170'A, and thus the first light path L1 is changed for the first time. The second reflecting member 180'A of the first group is disposed on a section of the first light path L1 after the second scanning lens 170'A, and thus the first light path L1 is changed for the second time. A section of the first light path L1 after the second reflecting member 180'A is directed to the photosensitive drum 210A disposed relatively far from the deflector 140.

Similarly, the first reflecting member 160'B of the second group is disposed on the second light path L2 between the first scanning lens 150'A and the second scanning lens 170'B, and thus the second light path L2 is changed for the first time. The second reflecting member 180'B of the second group is disposed on a section of the second light path L2 after the second scanning lens 170'B, and thus second light path L2 is changed for the second time. A section of the second light path L2 after the second reflecting member 180'B is directed to the photosensitive drum 210B disposed close to the deflector 140.

In particular, sections of the second light path L2 before and after the first change of the second light path L2 intersect a section of the first light path L1 after the second change of the first light path L1 (i.e., a section of the first light path L1 directed to the photosensitive drum 210A). Also, the section of the second light path L2 before the first change of the second light path L2 intersects a section of the second light path L2 after the second change of the second light path L2 (i.e., a section of the second light path L2 directed to the photosensitive drum 210B).

Further, a section of the first light path L1 before the first change of the first light path L1 is disposed above the section of the second light path L2 before the first change of the second light path L2, and the first light path L1 surrounds the first reflecting member 160'B and is directed to the photosensitive drum 210A.

In addition, the section of the first light path L1 before the first change of the first light path L1 intersects the section of the first light path L1 after the second change of the second light path L2 (i.e., the section of the first light path L1 directed to the photosensitive drum 210A), and also intersects the section of the second light path L2 after the second change of the second light path L2 (i.e., the section of the second light path L2 directed to the photosensitive drum 210B).

In the arrangement described above, the reflecting member 160'A of the first group and the reflecting member 160'D, which is symmetrical to the reflecting member 160'A with respect to the deflector 140, are disposed at both outermost sides of the light scanning unit 100' in a length direction of the light scanning unit 100', respectively. Further, the first reflecting member 160'B and the second reflecting member 180'B of the second group are disposed at both outermost side of the light scanning unit 100' in a thickness direction of the light scanning unit 100', respectively.

The light scanning unit 100' of the current embodiment may be made more compact in size and intervals D between photosensitive drums 210A, 210B, 210C, and 210D may be minimized by optimizing the light paths of the imaging optical system.

Hereinafter, a detailed design example of the light scanning unit 100 described with reference to FIGS. 2 and 3 will be described.

Figure 5:
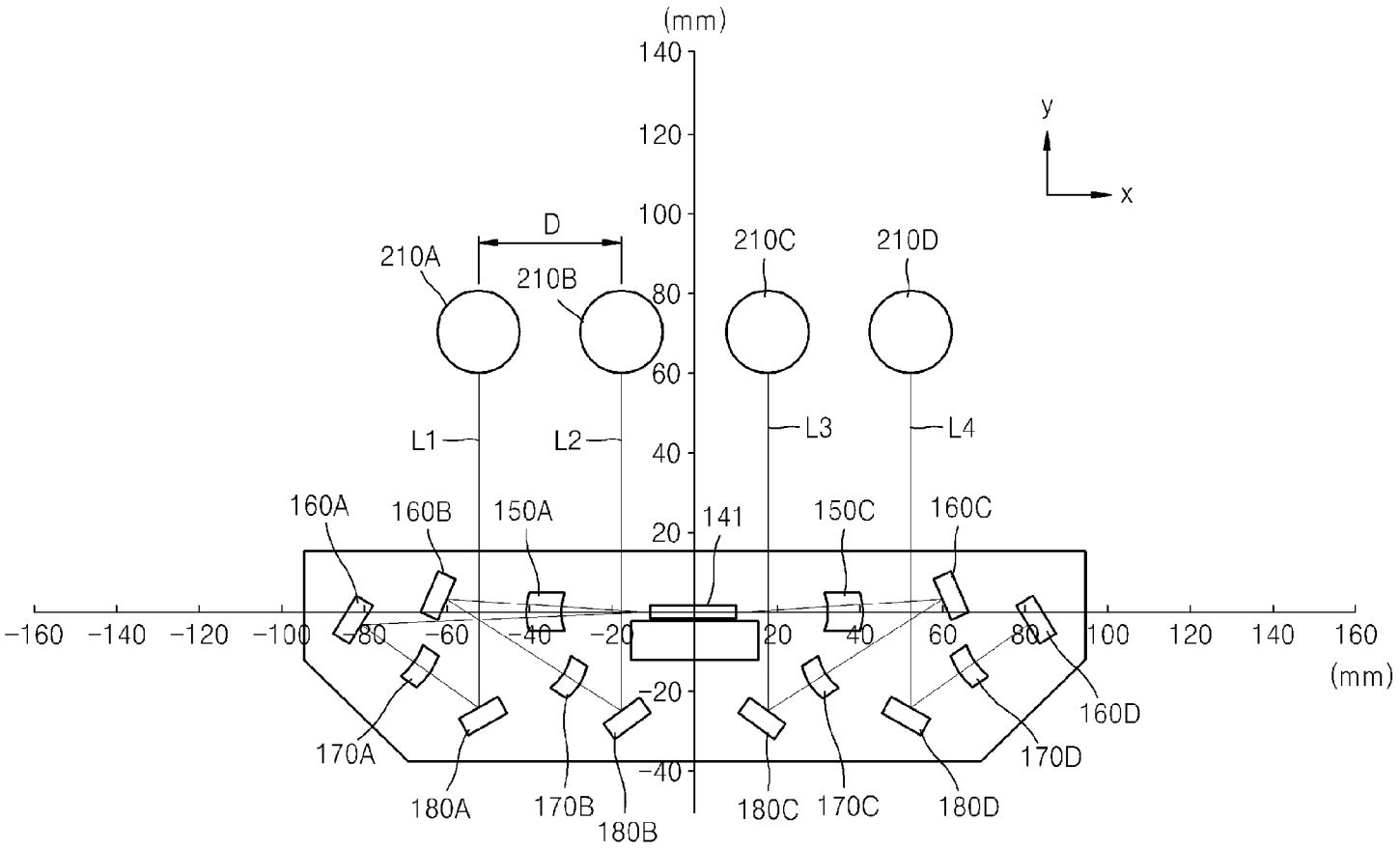
FIG. 5 is a view illustrating a detailed design of the light scanning unit of FIG. 2.

FIG. 5 is a view illustrating a detailed exemplary design of the light scanning unit 100. Detailed sizes of and intervals between optical components are shown in Table 1 and Table 2, as follow.

TABLE 1

| | | |
|---|---|---|
| photosensitive drum | pitch | 35 mm |
| deflector | number of deflection surfaces | 4 |
| | external diameter of deflector | 20 mm |
| | internal diameter of deflector | 14.14 mm |
| | distance between rotation axis of deflector and deflection surfaces | 5 mm |
| optical design | distance between deflector and first scanning lens | 25 mm |
| | thickness of first scanning lens | 10 mm |
| | distance between first scanning lens and second scanning lens | 55 mm |
| | thickness of second scanning lens | 5 mm |
| | distance between second scanning lens and photosensitive drum | 95 mm |
| | distance between deflector and photosensitive drum | 190 mm |
| light source | inclination angle of light beam | 3° |

TABLE 2

| | path L1 | | path L2 | | path L3 | | path L4 | |
|---|---|---|---|---|---|---|---|---|
| coordinates | x | y | x | y | x | y | x | y |
| axis of deflector | 0.0 | 0.0 | 0.0 | 0.0 | 0.0 | 0.0 | 0.0 | 0.0 |
| Deflector | −5.0 | 0.0 | −5.0 | 0.0 | 5.0 | 0.0 | 5.0 | 0.0 |
| first scanning lens | −30.0 | −1.3 | −30.0 | 1.3 | 30.0 | 1.3 | 30.0 | −1.3 |
| first reflecting members | −79.4 | −3.9 | −60.3 | 2.9 | 60.3 | 2.9 | 79.4 | −3.9 |
| second scanning lens | −66.7 | −12.8 | −31.0 | −15.5 | 31.0 | −15.5 | 66.7 | −12.8 |
| second reflecting members | −52.5 | −22.7 | −17.5 | −24.0 | 17.5 | −24.0 | 52.5 | −22.7 |
| photosensitive drums | −52.5 | 60.0 | −17.5 | 60.0 | 17.5 | 60.0 | 52.5 | 60.0 |

Referring to Table 2, a distance between the first reflecting member 160A of the first group disposed at an outermost side of the light scanning unit 100 in a length direction of the light scanning unit 100 and the reflecting member 160D symmetrical to the first reflecting member 160A with respect to the deflector 140 is 179.2 mm, and a distance between the first reflecting member 160B of the second group disposed at an outermost side of the light scanning unit 100 in a thickness direction of the light scanning unit 100 and the second reflecting member 180B symmetrical to the deflector 140 is 26.9 mm. As such, a size of the light scanning unit 100 of the current embodiment may be minimized by optimizing the light paths of the imaging optical system. Also, in Table 2, intervals between the photosensitive drums 210A, 210B, 201C, and 210D are 35 mm, and the total distance between the outermost photosensitive drums 210A and 210D is 105 mm. As a result, and as described above, in the light scanning unit 100 of the exemplary embodiments, the intervals between the photosensitive drums 210A, 210B, 201C, and 210D may be minimized.

According to a light scanning unit and an electrophotographic image forming apparatus employing the same, a spatial restriction inside the light scanning unit may be minimized, and the degree of freedom with respect to arrangement of optical components on a light path may be increased, and thus intervals between photoreceptors may be reduced and the size of the image forming apparatus may be reduced.

Although a few exemplary embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A light scanning unit, comprising:

a plurality of light sources configured to emit a plurality of light beams;

a deflector configured to deflect the light beams emitted from the light sources in a main scanning direction; and an imaging optical system configured to respectively focus the light beams deflected by the deflector onto a plurality of surfaces to be scanned, the imaging optical system including:

a first group of reflecting members configured to change a first light path at least twice, the first light path being a path of one of the light beams directed to one of the surfaces disposed relatively far from the deflector; and a second group of reflecting members configured to change a second light path at least twice, the second light path being a path of one of the light beams directed to one of the surfaces disposed relatively close to the deflector, wherein both of a section of the second light path before a first change of the second light path and a section of the second light path after the first change of the second light path intersect a section of the first light path after a second change of the first light path, and the first and second light paths remain on one side of the deflector from which the first and second light paths were deflected, respectively, such that the deflector deflects other light beams from another side of the deflector to create third and fourth light paths in directions opposite to the first and second light paths, respectively.

2. The light scanning unit of claim 1, wherein a section of the first light path before a first change of the first light path is disposed below the section of the second light path before the first change of the second light path with respect to a sub scanning direction, and the section of the second light path after the first change of the second light path intersects the section of the first light path before the first change of the first light path.

3. The light scanning unit of claim 2, wherein the section of the second light path before the first change of the second light path intersects a section of the second light path after a second change of the second light path.

4. The light scanning unit of claim 2, wherein the section of the first light path before the first change of the first light path intersects the section of the first light path after the second change of the first light path.

5. The light scanning unit of claim 2, wherein the section of the first light path before the first change of the first light path intersects a section of the second light path after a second change of the second light path.

6. The light scanning unit of claim 1, wherein a section of the first light path before a first change of the first light path is disposed above the section of the second light path before the first change of the second light path with respect to a sub scanning direction, and wherein the first light path surrounds a first reflecting member of the second group and is directed to one of the surfaces.

7. The light scanning unit of claim 6, wherein the section of the second light path before the first change of the second light path intersects a section of the second light path after a second change of the second light path.

8. The light scanning unit of claim 6, wherein the section of the first light path before the first change of the first light path intersects the section of the first light path after the second change of the first light path.

9. The light scanning unit of claim 6, wherein the section of the first light path before the first change of the first light path intersects a section of the second light path after a second change of the second light path.

10. The light scanning unit of claim 1, wherein the imaging optical system comprises: a first scanning lens that is commonly disposed on the first and second light paths, and a plurality of second scanning lenses that are respectively disposed on the first and second light paths.

11. The light scanning unit of claim 10, wherein the first scanning lens is disposed in sections of the first and second light paths before first changes of the first and second light paths, and the plurality of second scanning lenses are respectively disposed in sections of the first and second light paths after the first changes of the first and second light paths.

12. The light scanning unit of claim 1, wherein a first light beam on the first light path and a second light beam on the second light path are incident on a deflection surface of the deflector at different angles.

13. The light scanning unit of claim 12, wherein the first light beam on the first light path and the second light beam on the second light path are vertically symmetrically incident on the deflection surface of the deflector with respect to a line perpendicular to a rotation axis of the deflector.

14. The light scanning unit of claim 1, wherein the imaging optical system further comprises reflecting members and scanning lenses disposed on the third and fourth light paths, and the first light path and the second light path are disposed on a first side of the deflector and the third light path and the fourth light path are disposed on a second side of the reflector, the third light path and the fourth light path being symmetrical to the first and second light paths with respect to the deflector.

15. The light scanning unit of claim 14, wherein the third and fourth light paths are symmetrical to the first and second light paths with respect to a rotation axis of the deflector.

16. The light scanning unit of claim 1, wherein the number of reflecting members of the first group and the number of reflecting members of the second group are each at least two.

17. The light scanning unit of claim 1, wherein the light paths respectively directed to the surfaces are spaced apart from one another at regular intervals.

18. An image forming apparatus comprising:

a light scanning unit including a plurality of light sources configured to emit a plurality of light beams, a deflector configured to deflect the light beams emitted from the light sources in a main scanning direction, and an imaging optical system configured to respectively focus the light beams deflected by the deflector onto a plurality of surfaces to be scanned, the imaging optical system including:

a first group of reflecting members configured to change a first light path at least twice, the first light path being a path of one of the light beams directed to one of the surfaces disposed relatively far from the deflector, and a second group of reflecting members configured to change a second light path at least twice, the second light path being a path of one of the light beams directed to one of the surfaces disposed relatively close to the deflector, wherein a section of the second light path before a first change of the second light path and a section of the second light path after the first change of the second light path intersect a section of the first light path after a second change of the first light path, the first and second light paths remain on one side of the deflector from which the first and second light paths were deflected, respectively, such that the deflector deflects other light beams from another side of the deflector to create third and fourth light paths in directions opposite to the first and second light paths, respectively;

a developing unit including a plurality of photoreceptors disposed on each of a plurality of focusing points of the light beams emitted from the light scanning unit and a developing roller configured to develop an electrostatic latent image formed on each of the photoreceptors; and a transfer unit configured to transfer an image developed by the developing unit.

19. A light scanning unit comprising:

a plurality of light sources configured to emit a plurality of light beams;

a deflector configured to deflect the plurality of light beams in a first direction; and an imaging optical system configured to respectively focus the plurality of light beams deflected by the deflector onto a plurality of surfaces, the imaging optical system including:

at least two reflectors of a first group of reflectors configured to reflect a first light path at least twice, the first light path having a first portion, a second portion and a third portion, and being directed onto a first surface; and at least two reflectors of a second group of reflectors configured to reflect a second light path at least twice, the second light path having a first portion, a second portion and a third portion, and being directed onto a second surface disposed closer to the deflector than the first surface with respect to a direction perpendicular to the first direction, wherein the first portion of the second light path that is incident on a first reflector of the at least two reflectors of the second group of reflectors and the second portion of the second light path that is reflected by the first reflector of the at least two reflectors of the second group of reflectors intersect the third portion of the first light path that is reflected by both a first reflector and a second reflector of the at least two reflectors of the first group of reflectors, and the first and second light paths remain on one side of the deflector from which the first and second light paths were deflected, respectively, such that the deflector deflects other light beams from another side of the deflector to create third and fourth light paths in directions opposite to the first and second light paths, respectively.

20. The light scanning unit of claim 19, wherein the imaging optical system is configured to focus the plurality of light beams in a second direction, and the first direction is substantially perpendicular to the second direction.

21. The light scanning unit of claim 20, wherein the first portion of the first light path that is incident on the first reflector of the at least two reflectors of the first group of reflectors is disposed below the first portion of the second light path that is incident on the first reflector of the at least two reflectors of the second group of reflectors with respect to the second direction.

22. The light scanning unit of claim 21, wherein a third portion of the second light path that is reflected by both the first reflector and a second reflector of the at least two reflectors of the second group of reflectors intersects the first portion of the first light path that is incident on the first reflector of the at least two reflectors of the first group of reflectors.

23. The light scanning unit of claim 21, wherein the second portion of the second light path that is reflected by the first reflector of the at least two reflectors of the second group of reflectors intersects the first portion of the first light path that is incident on the first reflector of the at least two reflectors of the first group of reflectors.

24. The light scanning unit of claim 21, wherein the first portion of the first light path that is incident on the first reflector of the at least two reflectors of the first group of reflectors intersects the third portion of the first light path that is reflected by both the first reflector and the second reflector of the at least two reflectors of the first group of reflectors.

25. The light scanning unit of claim 21, wherein the first portion of the first light path that is incident on the first reflector of the at least two reflectors of the first group of reflectors intersects the third portion of the second light path that is reflected by both the first reflector and a second reflector of the at least two reflectors of the second group of reflectors.

26. The light scanning unit of claim 20, wherein the first portion of the first light path that is incident on the first reflector of the at least two reflectors of the first group of reflectors is disposed above the first portion of the second light path that is incident on the first reflector of the at least two reflectors of the first group of reflectors with respect to the second direction.

27. The light scanning unit of claim 26, wherein the first portion of the second light path that is incident on the first reflector of the at least two reflectors of the second group of reflectors intersects the third portion of the second light path that is reflected by both the first reflector and a second reflector of the at least two reflectors of the second group of reflectors.

28. The light scanning unit of claim 26, wherein the first portion of the first light path that is incident on the first reflector of the at least two reflectors of the first group of reflectors intersects the third portion of the first light path that is reflected by both the first reflector and the second reflector of the at least two reflectors of the first group of reflectors.

29. The light scanning unit of claim 26, wherein the first portion of the first light path that is incident on the first reflector of the at least two reflectors of the first group of reflectors intersects the third portion of the second light path that is reflected by both the first reflector and the second reflector of the at least two reflectors of the second group of reflectors.

30. The light scanning unit of claim 26, wherein both the first portion of the second light path that is incident on the first reflector of the at least two reflectors of the second group of reflectors and the second portion of the second light path that is reflected by the first reflector of the at least two reflectors of the second group of reflectors intersect the third portion of the first light path that is reflected by both the first reflector and a second reflector of the at least two reflectors of the first group of reflectors.

31. The light scanning unit of claim 19, wherein the imaging optical system further comprises:

a first scanning lens that is commonly disposed on the first and second light paths, and a plurality of second scanning lenses that are respectively disposed on the first and second light paths.

32. The light scanning unit of claim 31, wherein the first scanning lens is disposed in both the first portion the first light path that is incident on the first reflectors of the at least two reflectors of the first group of reflectors and the second portion the second light path that is incident on the first reflectors of the at least two reflectors of the second group of reflectors, and the plurality of second scanning lenses are respectively disposed in both the second portions of the first and second light paths that are reflected by the first reflectors of the at least two reflectors of the first and second groups of reflectors.

* * * * *

UNITED STATES PATENT AND TRADEMARK OFFICE

CERTIFICATE OF CORRECTION

PATENT NO. : 8,872,874 B2
APPLICATION NO. : 13/292476
DATED : October 28, 2014
INVENTOR(S) : Hyung-soo Kim et al.

It is certified that error appears in the above-identified patent and that said Letters Patent is hereby corrected as shown below:

In the Claims

Column 18, line 30-31, in Claim 32, delete "portion the" and insert -- portion of the --, therefor.
Column 18, line 33, in Claim 32, delete "portion the" and insert -- portion of the --, therefor.

Signed and Sealed this
Fifth Day of May, 2015

Michelle K. Lee

Michelle K. Lee
*Director of the United States Patent and Trademark Office*